United States Patent [19]

Montagnino et al.

[11] 4,160,899

[45] Jul. 10, 1979

[54] DETENT REMOVER FOR A POSTAGE METER

[75] Inventors: James G. Montagnino, Monroe, Conn.; Frederick J. Staudinger, North Salem, N.Y.

[73] Assignee: Pitney-Bowes, Inc., Stamford, Conn.

[21] Appl. No.: 864,207

[22] Filed: Dec. 27, 1977

[51] Int. Cl.[2] ..... G07G 1/00

[52] U.S. Cl. ..... 235/101; 235/58 P; 235/60 P; 400/664

[58] Field of Search ..... 235/81 A, 101, 92 EH, 235/130 R, 139 R, 58 P, 60 P; 74/439; 101/45, 91; 400/663–667, 676–678

[56] References Cited

U.S. PATENT DOCUMENTS

| | | | |
|---|---|---|---|
| 2,168,457 | 8/1939 | Strother | 235/130 R |
| 2,587,766 | 4/1952 | Rovan | 235/139 R |
| 2,655,315 | 10/1953 | Persson | 235/130 R |
| 3,002,686 | 10/1961 | Heil et al. | 235/101 |
| 3,823,666 | 7/1974 | Hanson | 235/101 |
| 3,892,355 | 7/1975 | Malavazos | 235/101 |
| 3,949,203 | 4/1976 | Malavazos et al. | 235/101 |

*Primary Examiner*—L. T. Hix
*Assistant Examiner*—Benjamin R. Fuller
*Attorney, Agent, or Firm*—Peter Vrahotes; William D. Soltow, Jr.; Albert W. Scribner

[57] ABSTRACT

A postage meter is provided with a combination whereby the detent members retarding the selector gears of the postage meter are removed immediately prior to the changing of the postage amount. The combination is also able to engage a bail lock-out mechanism at the same instant the detent is removed to prevent accidental meter trips or tampering with the meter.

8 Claims, 5 Drawing Figures

Fig. 1
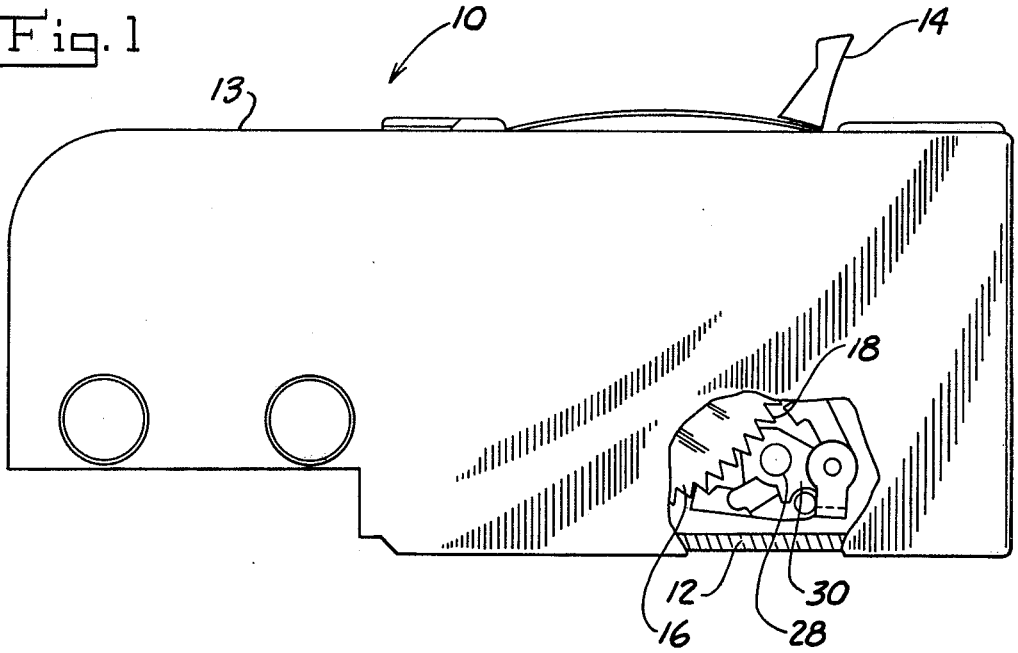
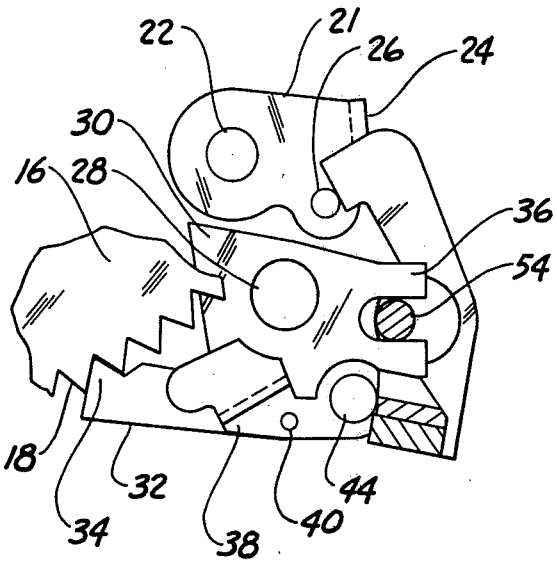
Fig. 2
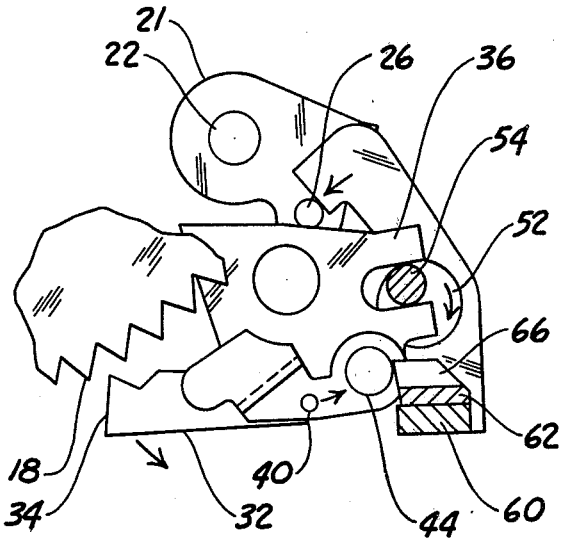
Fig. 3

DETENT REMOVER FOR A POSTAGE METER

BACKGROUND OF THE INVENTION

In present day postage meters, detents are provided for the selector gears of the print wheels so that the print wheels may be accurately located and inhibited from inadvertent movement. Additionally, a locking member is provided so that the postage meter may not be tripped during the changing of the print wheels. The present trend in the postage meter field is to provide a mechanism for automatically setting a postage meter as opposed to the meter being set manually. An example of a mechanism for the automatic setting of a postage meter may be found in U.S. Pat. No. 4,030,070. It has been found that a problem has arisen with the automatic setting of postage meters in that the detent members which hold the selector gears in place tend to wear out more rapidly than has been the case with manually operable setting mechanisms. This is probably occasion by the automatic setting mechanism not having a "feel" for the detented members as the amount of postage is being changed, not being able to accommodate high speed setting, and because of the use of low force actuators such as stepper motors, solenoids and the like.

SUMMARY OF THE INVENTION

It has been found that the detent mechanism of a postage meter may be prevented from premature wear by disabling the same from the postage meter selector gears immediately prior to the setting of the postage meter print wheels. This is accomplished by having the detent mechanism of each selector gear rotatably mounted on a shaft with an eccentric drive member contacting the detent so that upon rotation of the eccentric member the detents are removed from the gear teeth. The eccentric drive member is enabled immediately before the changing of the postage meter print wheels and recorder. A lever is associated with the eccentric member so that upon rotation of the latter the lock-out mechanism of the postage meter is also engaged to prevent accidental meter tripping or tampering with the meter. A feature of the detent removal means include a self-locking property that prevents retraction of the detents and consequential rotation of the selector gears unless the eccentric member is rotated.

BRIEF DESCRIPTION OF THE DRAWINGS

FIG. 1 shows a side view of a postage meter of the type to which the instant invention may be applied, a portion of the meter cover being removed for purposes of illustration.

FIGS. 2 and 3 show a detailed view of the detent removal mechanism included in the postage meter of FIG. 1 in different modes of operation.

DETAILED DESCRIPTION OF THE PREFERRED EMBODIMENT

Figure 4:
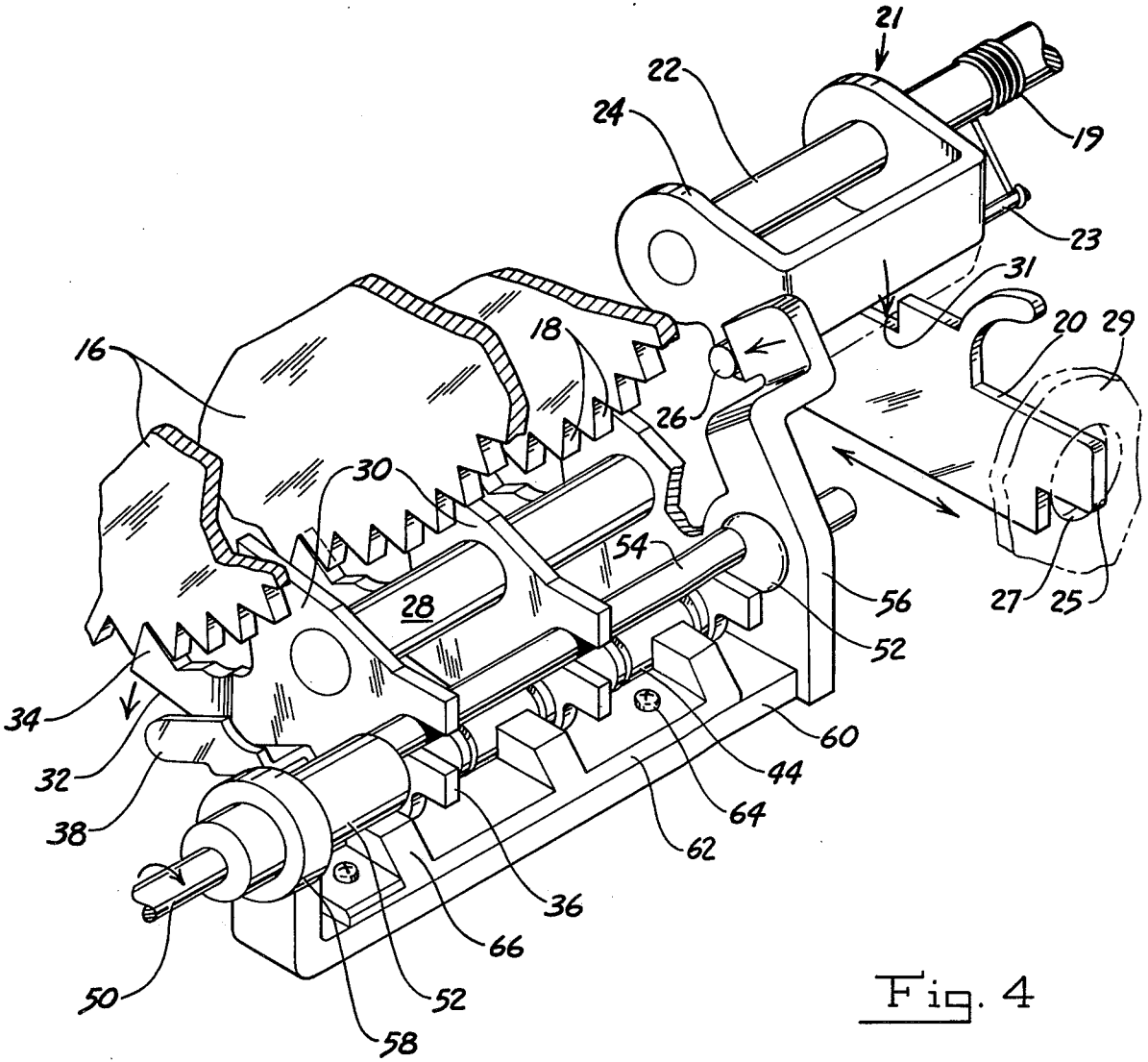
FIG. 4 shows a prespective view of the detent removal mechanism shown in FIGS. 2 and 3.
Figure 5:
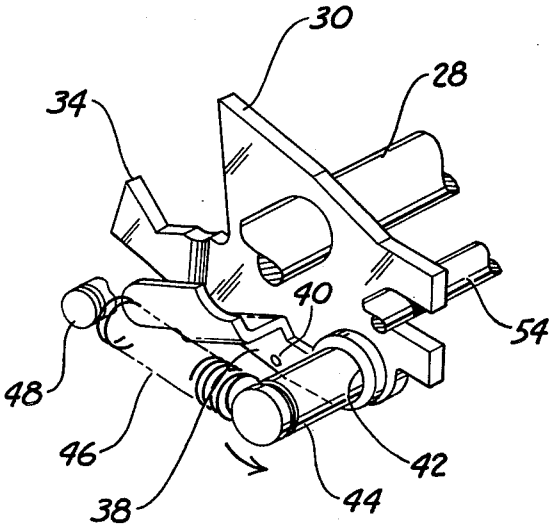
FIG. 5 shows an enlarged detailed view of a portion of the mechanism shown in FIG. 4.

A postage meter is shown generally at 10 and has a housing 12 with a cover 13 thereover that contains a lever 14 which extends partially therefrom and is used to adjust the postage meter setting through driving of selector gears 16 that have gear teeth 18 thereabout.

Examples of such postage meter 10 may be found among the 5300 series postage meters manufactured and marketed by Pitney Bowes, Inc. the assignee of the instant invention. Construction of postage meters is well known and will not be described hereinafter in detail, the reader being referred to U.S. Pat. Nos. 2,534,376; 2,552,182; 2,657,593 and 2,774,537 for details of such postage meter construction. The postage meters 10 are provided with a lock-out shutter bar 20 (see FIG. 4) so that a false trip cannot occur. A lock-out mechanism 21 is disposed within the cover 13 and includes a shaft 22 that is secured, within the frame 12 and has a spring 19 disposed thereabout. A bail member 24 is rotatably supported by the shaft 22 above the lock-out shutter bar 20 and has a pair of pins 23 and 26. The spring 19 engages the pin 23 to urge the bail member 24 in a counterclockwise direction as seen in FIG. 4. The shutter bar 20 is an elongated member having a finger 25 that is adapted to be received within an opening 27 of a drive print wheel gear 29 (only partially shown). The shutter bar 20 includes a shoulder 31 located adjacent the bail 24. Means (not shown) is provided for longitudinally moving the shutter bar 20 in the direction shown by the double arrow in FIG. 4 to remove the finger 25 from the opening 27 so that the print wheel gear 29 may be rotated as required.

Disposed within the housing 12 is a fixed shaft 28 that has a plurality of detent members 30 rotatably disposed thereon, there being an equal number of detent members and selector gears 16. The detent members 30 have an arm 32 that extend therefrom, each arm having a pointed end 34 that is adapted to be received between the teeth 18 of a selector gear 16. The other end of each detent member 30 is provided with a yoke forming opening 36. A lever 38 is secured to each of the detent members 30 as by a rivet 40. An opening 42 extends through each lever 38 and its associated detent member 30 and securely receives a pin 44. A spring 46 (see FIG. 5) extends from the pin 44 to another pin 48 secured to the housing 12 to bias the detent members 30 in a clockwise direction about the shaft 28 as seen in FIGS. 1-5. The spring 46 tends to urge the detent member 30 about the shaft 28 so as to urge the pointed end 34 into engagement with the gear teeth 18.

A shaft 50 is rotatably received within the housing 12 and has opposed enlarged portions 52. A rod 54 is eccentrically mounted between the enlarged portions 52 and is received within the openings 36 of the detent members 30. Means (not shown) is provided for rotating the shaft 50 in the direction of an arrow shown in FIG. 4. As a result of this rotation, the detent members 30 are rotated counterclockwise about the shaft 28 to overcome the spring 46 and pull the pointed end 34 away from the gear teeth 18 thereby disengaging the same.

Disposed about one of the enlarged portions 52 is a bail lever 56 and disposed about the other enlarged portion is an eyelet member 58, there being a bar 60 that depends from the eyelet member and extends to the bail lever to be integral therewith. A plate 62 is secured to the bar 60 as by bolts 64 and the plate has a plurality of lands 66 thereon which engage the pins 44 extending through the detent members 30.

In operation, as the shaft 50 is rotated in a clockwise direction, it will rotate the eccentrically mounted rod 54 which in turn will rotate the detent members 30 in a counterclockwise direction by overcoming the spring 46. With this counterclockwise rotation, the pointed ends 34 will be removed from between the teeth 18 to allow free rotation of the selector gears 16. The pins 44 that abutt the shoulders 66 will be carried by the detent member 30 to drive the bail lever 56 in a direction as shown by an arrow in FIG. 4. With this occurrence the bail 24 will be rotated about the shaft 22 by the bail lever acting upon the pin 26. This will cause the bail 24 to be located in a position to engage the shoulder 31 to prevent movement of the shutter bar 20 in a direction to the left as seen in FIG. 4 thereby assuring that the finger 25 is inserted in the opening 27 to prevent rotation of the meter drive gears 29 thereby negating the possibility of tripping the meter.

As shown in FIG. 2, when the detents 30 are engaged with the selector gears 16, the eccentrically mounted rod 54 tends to be placed in a self locking position vis-a-vis the selector gears 16. More specifically, when the pointed end 34 of each detent 30 is fully received within the selector gear teeth 18, the eccentrically mounted rod 54 is in its rest position. This rest position places the eccentrically mounted rod 54 approximately intermediate the top dead center and the bottom dead center of the eccentric motion of the rod. As is known in the art, the top dead center and bottom dead center are the two positions of an eccentric where maximum displacement of the driven member, in this case the detent 30, occurs. Because of the pressure angle created when the rod 54 assumes its rest position, it provides a self-locking mechanism in combination with the yoke 36. This self-locking feature will tend to prevent attempts to release the engagement of the pointed end 34 with the teeth 18 through tampering thereby frustrating unauthorized efforts to rotate the selector gears 16.

With the mechanism shown and described, a device has been provided whereby the detent means 30 may be removed from engagement with the selector gears 16 and the lockout shutter bar 20 will be engaged immediately prior to the postage being automatically set. As described in U.S. Pat. No. 4,030,070 a signal is given to the respective levers for driving the lever arms 14. Immediately prior to this signal being sent a corresponding signal may be sent to a mechanism, such as a solenoid, that would be operative with appropriate linkage to rotate the shaft 50 as described above. As one skilled in the art would recognize, any type of associated enabling mechanisms may be used to rotate the shaft 50 upon initiation of the setting of the postage meter print wheels.

What is claimed is:

1. In a postage meter of the type having a housing containing a plurality of selector gears in operative engagement with print wheels for changing the setting of the print wheels upon actuation of the selector gears, the combination comprising: eccentric means rotatably received with the housing, detent means rotatably supported within the housing having a first portion in engagement with a selector gear and a second portion engageable with said eccentric means whereby upon rotation of said eccentric means said detent means rotate out of engagement with said selector gear.

2. In a postage meter of the type having a housing containing a plurality of selector gears for changing the setting of the print wheels upon rotation of the gears, the combination comprising: eccentric means rotatably received with the housing, a shaft received within the housing and spaced parallel to said eccentric means, a detent member rotatably supported on said shaft and having a first portion in engagement with a selector gear and a second portion in engagement with said eccentric means, whereby upon rotation of said eccentric means said detent means is rotated about said shaft and out of engagement with said selector gear.

3. The postage meter of claim 2 wherein the selector gears have gear teeth disposed upon the perimeter thereof and said first portion of said detent member includes a pointed end that is receivable between said gear teeth and including biasing means for urging said pointed end into engagement is said gear teeth.

4. The postage meter of claim 3 wherein said eccentric means is located approximately intermediate its top dead center and bottom dead center when said pointed end of said detent member is in engagement with said gear teeth.

5. In a postage meter of the type having a housing containing a plurality of selector gears in operative engagement with a print wheel for changing the setting of the print wheels upon rotation of the gears and a releasable lockout shutter bar for preventing tripping of the postage meter, the combination comprising: eccentric means rotatably received with the housing, at least one detent member rotatably supported within the housing and having a first portion engageable with a selector gear and a second portion engageable with said eccentric means, biasing means supported within the housing and engaging said detent member to urge said detent member into engagement with the selector gear, a bail rotatably received with the housing having one portion in engagement with said eccentric means and another portion adjacent the shutter bar, whereby upon rotation of said eccentric means said detent member is rotated out of engagement with said selector gear by overcoming said biasing means and said bail is rotated to engage the shutter bar.

6. The postage meter of claim 5 wherein said shutter bar has a shoulder thereon and said bail is engageable with said shoulder upon rotation of said eccentric means to prevent movement of the shutter bar.

7. The postage meter of claim 5 wherein said eccentric means is located approximately intermediate its top dead center and bottom dead center positions when said detent member is in engagement with said selector gear.

8. The postage meter of claim 5 including biasing means supported by the housing and in engagement with said bail to urge said bail away from the shutter bar.

* * * * *